US006935689B2

(12) United States Patent
Horiki et al.

(10) Patent No.: US 6,935,689 B2
(45) Date of Patent: Aug. 30, 2005

(54) CHAIR

(75) Inventors: Toshiyuki Horiki, Nagano (JP); Nobuyuki Ueda, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 69 days.

(21) Appl. No.: 10/442,101

(22) Filed: May 21, 2003

(65) Prior Publication Data

US 2004/0004380 A1 Jan. 8, 2004

(30) Foreign Application Priority Data

Jul. 3, 2002 (JP) ..... P2002-194032

(51) Int. Cl.[7] ..... A47C 1/024

(52) U.S. Cl. ..... 297/300.5; 297/300.7; 297/302.6; 297/302.7; 297/302.5

(58) Field of Search ..... 297/300.5, 302.4, 297/300.6, 300.7, 300.8, 302.5, 302.6, 302.7

(56) References Cited

U.S. PATENT DOCUMENTS 4,889,384 A * 12/1989 Sulzer ..... 297/303.4
4,988,145 A * 1/1991 Engel ..... 297/300.4
5,033,791 A * 7/1991 Locher ..... 297/302.3
5,056,866 A * 10/1991 Tobler ..... 297/303.3
5,203,853 A * 4/1993 Caruso ..... 297/303.3
5,249,839 A * 10/1993 Faiks et al. ..... 297/300.1
5,397,165 A * 3/1995 Grin et al. ..... 297/300.5
5,464,274 A * 11/1995 Golynsky et al. ..... 297/328
5,584,533 A * 12/1996 Schrewe ..... 297/300.2
5,683,139 A * 11/1997 Golynsky et al. ..... 297/302.3
5,918,935 A * 7/1999 Stulik et al. ..... 297/300.5
6,234,573 B1 * 5/2001 Roder et al. ..... 297/300.5
6,238,000 B1 * 5/2001 Hallmark et al. ..... 297/300.5
6,523,896 B1 * 2/2003 Uhlenbrock ..... 297/300.4
6,659,555 B1 * 12/2003 Scholz et al. ..... 297/302.2

FOREIGN PATENT DOCUMENTS

DE 295 16 840 2/1996
EP 0 460 717 A2 12/1991

* cited by examiner

*Primary Examiner*—Peter M. Cuomo
*Assistant Examiner*—Erika Garrett
(74) *Attorney, Agent, or Firm*—Banner & Witcoff Ltd.

(57) ABSTRACT

The chair comprises an axis X1 that extends right and left and that connects a seat 6 and a supporting body 3 arranged under the seat 6 in a rotatable manner at a front end portion of the seat frame 4, an axis X2 that connects the seat 6 and a backrest 7 in a rotatable manner at a rear side to the axis X1 and an axis X3 that connects the backrest 7 and the supporting body 3 in a rotatable manner, and the seat and the backrest are made to make a rocking movement between an upright posture and a rearward tilted posture with synchronizing the seat and the backrest by adopting an arrangement of a sliding engagement structure to a supporting portion of the axis, and the chair is also provided with a restraining member B1 to restrain a sliding range of the axis X1 variably by directly working the axis X1 to be restrained, an operating member B2 to operate the restraining member B1, a transmitting axis B3 to transmit an operating force of the transmitting member B2 to the restraining member B1 and a click stop mechanism B4 to fix the restraining member B1 at a recessed position (p) where the sliding range of the axis X1 is not restrained or one of a plurality of the restraining positions (q1), (q2), (q3) where the sliding range of the axis X1 is restrained.

20 Claims, 12 Drawing Sheets

CHAIR

CROSS REFERENCE TO RELATED APPLICATIONS

This application is based upon and claims the benefit of priority from the prior Japan Patent Application No. P2002-194032, filed Jul. 3, 2002, the entire contents of which are incorporated herein by reference.

BACKGROUND OF THE INVENTION AND RELATED ART STATEMENT

This invention relates to a chair in which a seat and a backrest can make a rocking movement with synchronizing the seat and the backrest.

Conventionally, a chair of this kind has been so arranged that a seat and a backrest can make a rocking movement between an upright posture and a rearward tilted posture with synchronizing the seat and the backrest by a synchronized tilt mechanism equipped with a various kind of rocking devices. However, this kind of chair cannot change the rearward tilted posture. In view of the above problem, a chair has recently been developed in which a rocking range as an angle between an upright posture and a rearward tilted posture can be adjusted.

Some chairs of the above arrangement are provided with a mechanism to adjust the rocking range in a space from a center along back and forth to rearward of a supporting body or a seat frame locating under the seat and fixed to the upper end portion of the leg.

However, with the above arrangement if an operating member to adjust the rocking range is arranged at a front side of the seat that is accessible for a seated person, a transmitting mechanism to transmit an operating force of the operating member to an adjusting mechanism to adjust the rocking range that is arranged in a space from the center to rearward of the supporting body or the seat frame becomes complicated and large, thereby to be bulky as a whole.

Further, a highly-functioned chair that has been recently developed is provided with a mechanism to support a backrest, a mechanism to elevate a seat, a mechanism to mount a back cover on a backrest or other various mechanisms around a space from a center to rearward of a supporting body or a seat frame and a variety of components constituting the above mechanisms are arranged there. As a result of this, in order to arrange the adjusting mechanism near the above-mentioned mechanisms the adjusting mechanism has to be arranged at a position that does not interfere the other components, thereby to decrease a degree of freedom in design.

SUMMARY OF THE INVENTION

In order to solve the above problems, the present claimed invention is a chair comprising a first axis that extends right and left and that connects a seat and a supporting body arranged under the seat in a rotatable manner at a front end portion of the seat, a second axis that connects the seat and a backrest in a rotatable manner at a rear side to the first axis and a third axis that connects the backrest and the supporting body in a rotatable manner, wherein the seat and the backrest are made to make a rocking movement between an upright posture and a rearward tilted posture with synchronizing the seat and the backrest by adopting an arrangement of a sliding engagement structure to a supporting portion of the first axis, and characterized by that a restraining member is provided to restrain a sliding range of the first axis variably by directly working the first axis to be restrained.

In accordance with the arrangement, since the rocking range of the seat and the backrest can be changed by the restraining member and the restraining member is so arranged to work directly to the first axis arranged at the front end portion of the seat, it is possible to arrange the members or the mechanism to change the rocking range at a front side of the seat that is accessible for the seated person without difficulty. In addition, since there are a few members arranged at a side of the front end portion of the seat or the supporting body by nature, it is possible to arrange the restraining member and the member or the mechanism to operate the restraining member without considering interference between the member or the mechanism, resulting in improvement of a degree of freedom in design. Especially, it is extremely preferable that a degree of freedom in design is high for a recent highly functioned chair having a complicated structure in order to downsize the chair by preventing interference between the members.

A preferable sliding engagement structure is represented by that the first axis is set at a seat side and that a sliding engaging portion is formed on the supporting body to guide the first axis in a slidable manner. "The axis is set" means to provide a state in which a relative position between an object and the axis does not change and is a concept including that the axis is arranged through a bearing and that the axis is fixed. In addition, it is convenient if the sliding guide is a long hole.

As a preferable concrete embodiment of the chair it is represented that the chair further comprises an operating member and a transmitting member that transmits an operating force of the operating member to the restraining member and the restraining member is moved or transformed between a restraining position where a sliding range of the first axis is restrained and a recessed position where the sliding range of the first axis is not restrained with an operation of the operating member. In order to make an arrangement of the transmitting member and the operating member very simple in a cy-pres manner, it is preferable that the transmitting member is a transmitting axis that extends right and left and that is fixed to the restraining member and that the operating member is, for example, a lever or a grip arranged at a distal end portion of the transmitting axis. In order to downsize the restraining member that directly works to the first axis, it is preferable that the transmitting axis fixed to the restraining member is arranged near the first axis in parallel with the first axis.

In order to downsize whole of the restraining member by reducing an occupied area accompanied with a movement of the operating member in a cy-pres manner it is preferable that the restraining member is arranged to move rotary together with the transmitting axis among the recessed position and the restraining positions.

In order to further improve feeling to sit on the chair of the present claimed invention, it is preferable that the restraining member is so arranged to restrain the sliding range of the first axis at a plurality of different restraining positions set in a stepwise manner. As a concrete embodiment of the restraining member to restrain the first axis at a plurality of the different restraining positions, it is represented that the restraining member is provided with a plurality of restraining faces that make an abutting contact with the first axis at the above-mentioned plurality of different restraining positions and a plurality of the restraining faces are so arranged that one of a plurality of the restraining faces selectively makes an abutting contact with the first axis with the operation of the operating member.

For a case that a plurality of the restraining positions are set it is preferable that a click stop mechanism is arranged to fix the restraining member at a plurality of the restraining positions.

As a simple and concrete embodiment of the transmitting member and the operating member it is represented that the transmitting member is a transmitting axis that extends right and left and that is fixed to the restraining member and the operating member is arranged at a distal end of the transmitting axis. In this case it is preferable that the restraining member extends toward a direction making a right angle with the transmitting member and is so arranged to rotate together with the transmitting axis with the operation of the operating member. Further, if the transmitting axis is arranged near the first axis in parallel with the first axis, it is possible to shorten a length of the restraining member, to downsize whole of the mechanism and to operate the operating member with a small force as well.

In order to appropriately restrain the sliding movement to the first axis extending right and left, it is preferable that the restraining member is arranged at a general center along right and left of the supporting body.

In addition, it is preferable that the above-mentioned restraining member is so constructed to restrain a sliding range of the first axis at a rear side of the first axis. In order to take a rearward tilted posture the seat is slid rearward, which makes it possible to restrain the sliding range without difficulty. In addition, the chair may further comprise a second restraining member that restrains the sliding range of the first axis at a front side of the first axis so that the sliding range can be restrained at the front side and the rear side. With this arrangement, if a rocking range is changed, a feeling to sit on the chair can be further improved. The second restraining member may be of the same kind as the first restraining member or may be different.

DETAILED DESCRIPTION OF THE PREFERRED EMBODIMENTS

Figure 1:
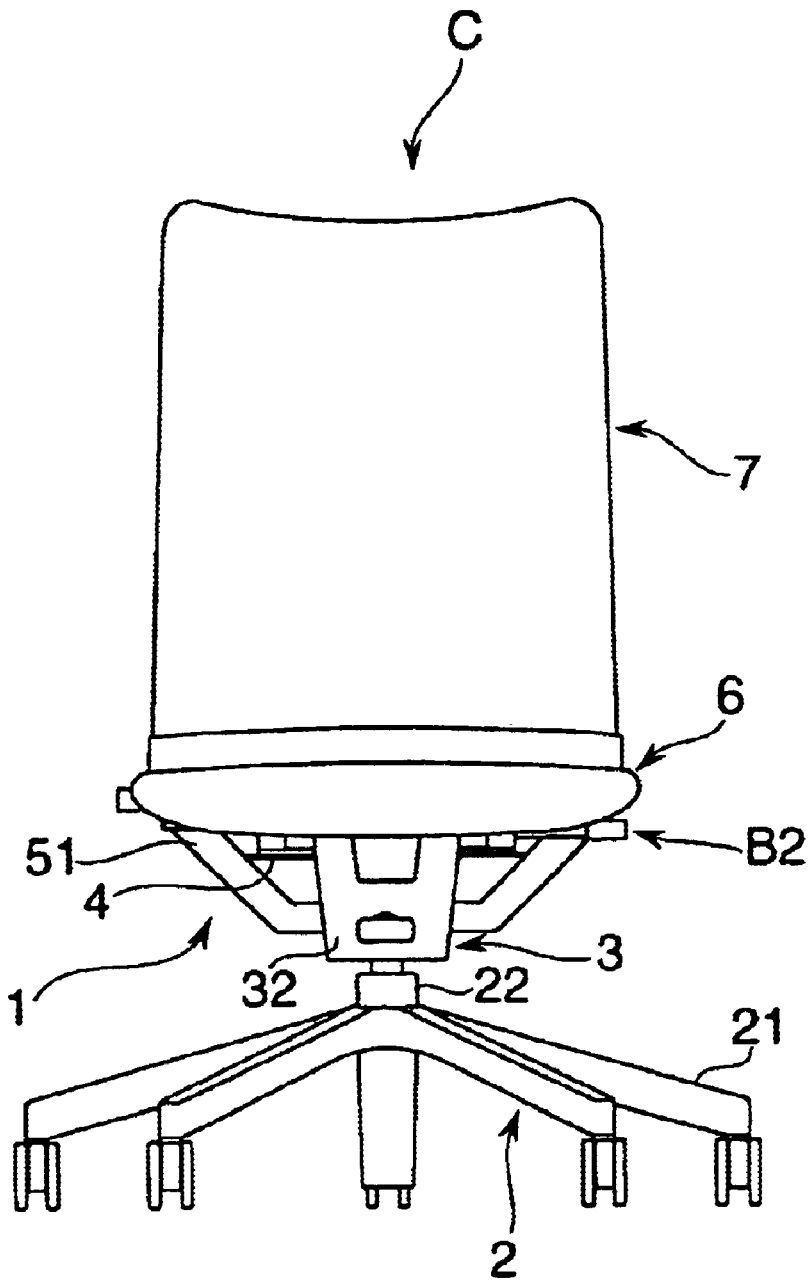
FIG. 1 is a front view of a chair in accordance with one embodiment of the present claimed invention.
Figure 2:
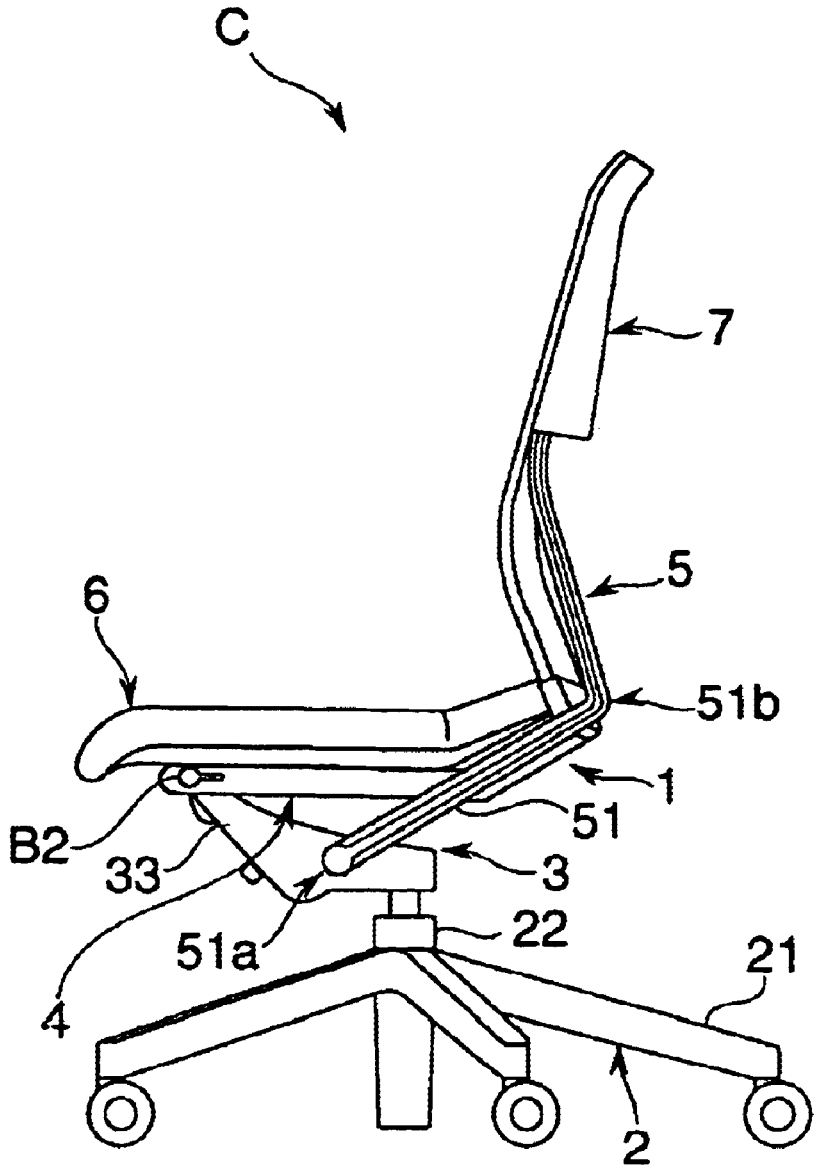
FIG. 2 is a side view of the chair in accordance with the embodiment.

An embodiment of the present claimed invention will be described in detail with reference to the accompanying drawings. A chair C in accordance with this embodiment is, as shown in FIG. 1 and FIG. 2, so arranged that a chair body 1 as a basis of a structure comprises a leg 2, a supporting body 3 mounted on an upper end side of the leg 2, a seat frame 4 whose front is supported by the supporting body 3 and a back frame 5 whose proximal end is mounted on the supporting body 3 and whose middle portion supports a rear portion of the seat frame 4, wherein a seat 6 is constituted by mounting a shell and a cushion, not shown in drawings, on the seat frame 4 of the chair body 1 and a backrest 7 is constituted by mounting a backrest body comprising an upholstery fabric or a core member, not shown in drawings, on the back frame 5.

The leg 2 is so arranged that a leg post 22 upstands at a center of five leg wings 21 wherein the leg post 22 can be moved up and down and a gas spring mechanism, not shown in drawings, is incorporated thereinto.

The supporting body 3 is mounted on an upper end portion of the supporting post 22 in a rotatable manner and, as shown in FIG. 3, FIG. 4, FIG. 5 and FIG. 6, comprises a bottom wall 31 that extends to a direction of a front horizontally and a part of which the leg post 22 penetrates vertically, a front wall 32 that uprights from a front end of the bottom wall 31 toward a direction of an inclined front, and right and left side walls 33, 34 that stand uprightly from circumferences of the bottom wall 31 and the front wall 32 and that constitute a space that opens inward and upward to accommodate mechanisms together with the bottom wall 31 and the front wall 32 so as to form a generally boat shape. At a front end portion of the side walls 33, 34 of the supporting body 3 formed is a long hole N as a sliding guide portion that supports an axis X1 which will be described later in a slidable manner along back and forth. An axis X3 that is mounted on the back frame penetrates the supporting body 3 at a position crossing over the bottom wall 31 with bridging the right and left walls 33, 34. The axis X3 connects the supporting body 3 and the backrest 7 comprising the back frame 5 in a rotatable manner and corresponds to the third axis described in claim 1 of the present claimed invention. The supporting body 3 is covered with, for example, a cover member K made of resin (refer to FIG. 3) so as not to expose an inner structure or a metal surface of the material. The cover member K is omitted to show in FIG. 4, FIG. 5 and FIG. 6.

Figure 3:
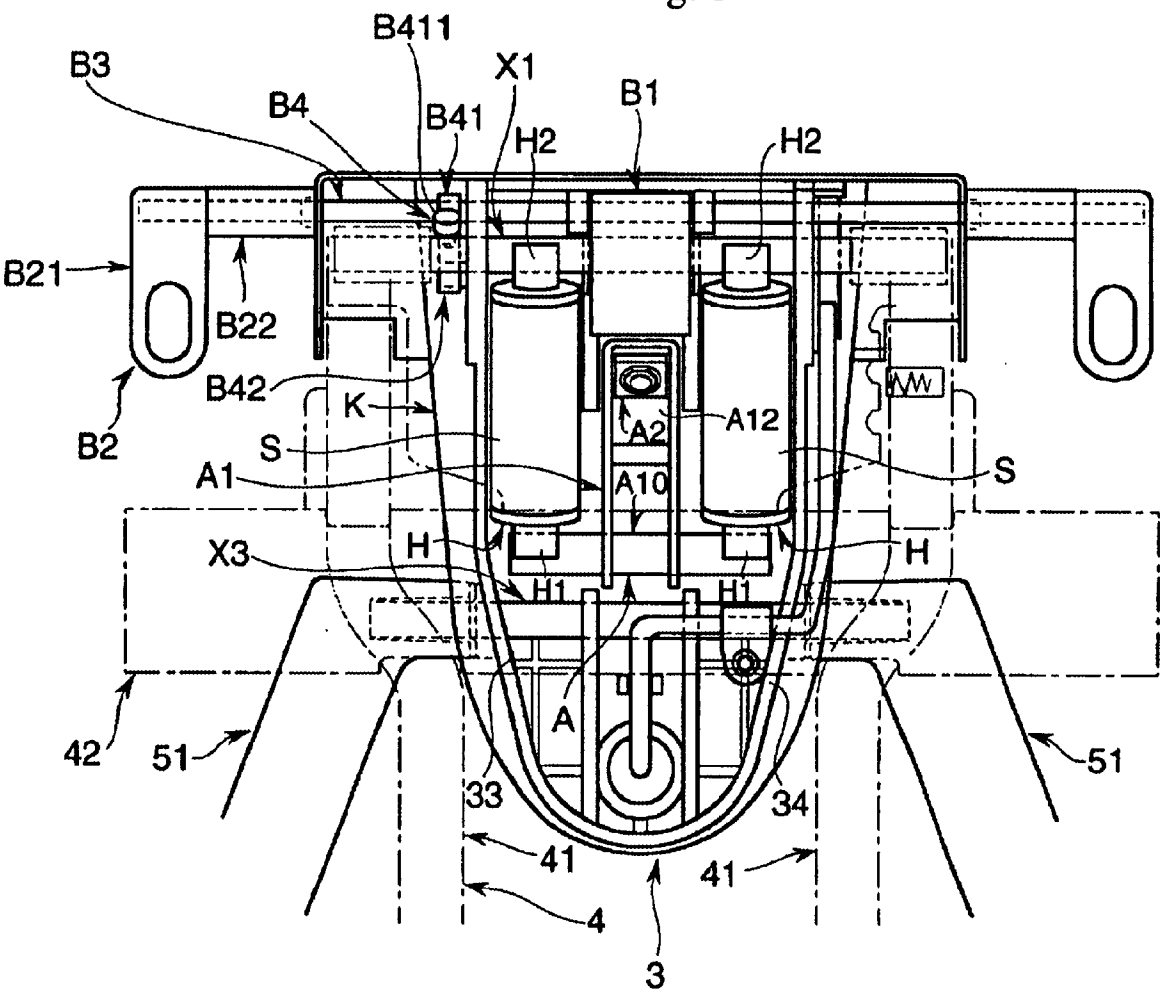
FIG. 3 is a plane view, a part of which is omitted to show, showing around a supporting body in accordance with the embodiment.

The seat frame 4, whose plane view is shown by an imaginary line in FIG. 3, comprises longitudinal frames 41 that locate above the supporting body 3 and that extend back and forth and a transversal frame 42 that bridges to connect middle portions of the longitudinal frames 41. The longitudinal frames 41 of this embodiment are so formed that a rear side to the transversal frame 42 is narrower in distance than a front side to the transversal frame 42. On a position near a front end of the longitudinal frame 41 mounted is the axis X1 that extends right and left so as to cross over the longitudinal frames 41. The axis X1 connects the seat 6 and the supporting body 3 in a rotatable manner and corresponds to the first axis described in claim 1 of the present claimed invention.

Figure 5:
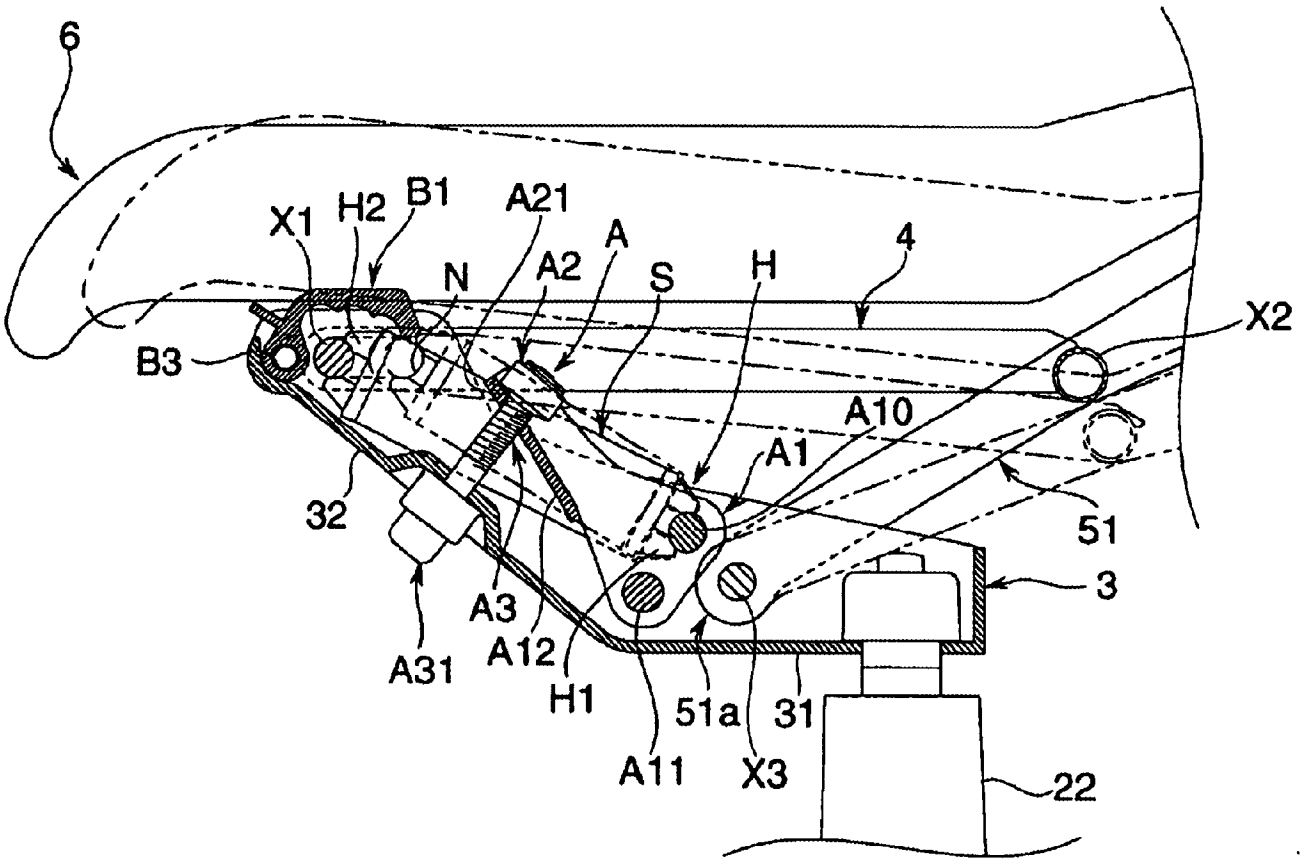
FIG. 5 is a longitudinal cross-sectional view showing around the supporting body in accordance with the embodiment.
Figure 6:
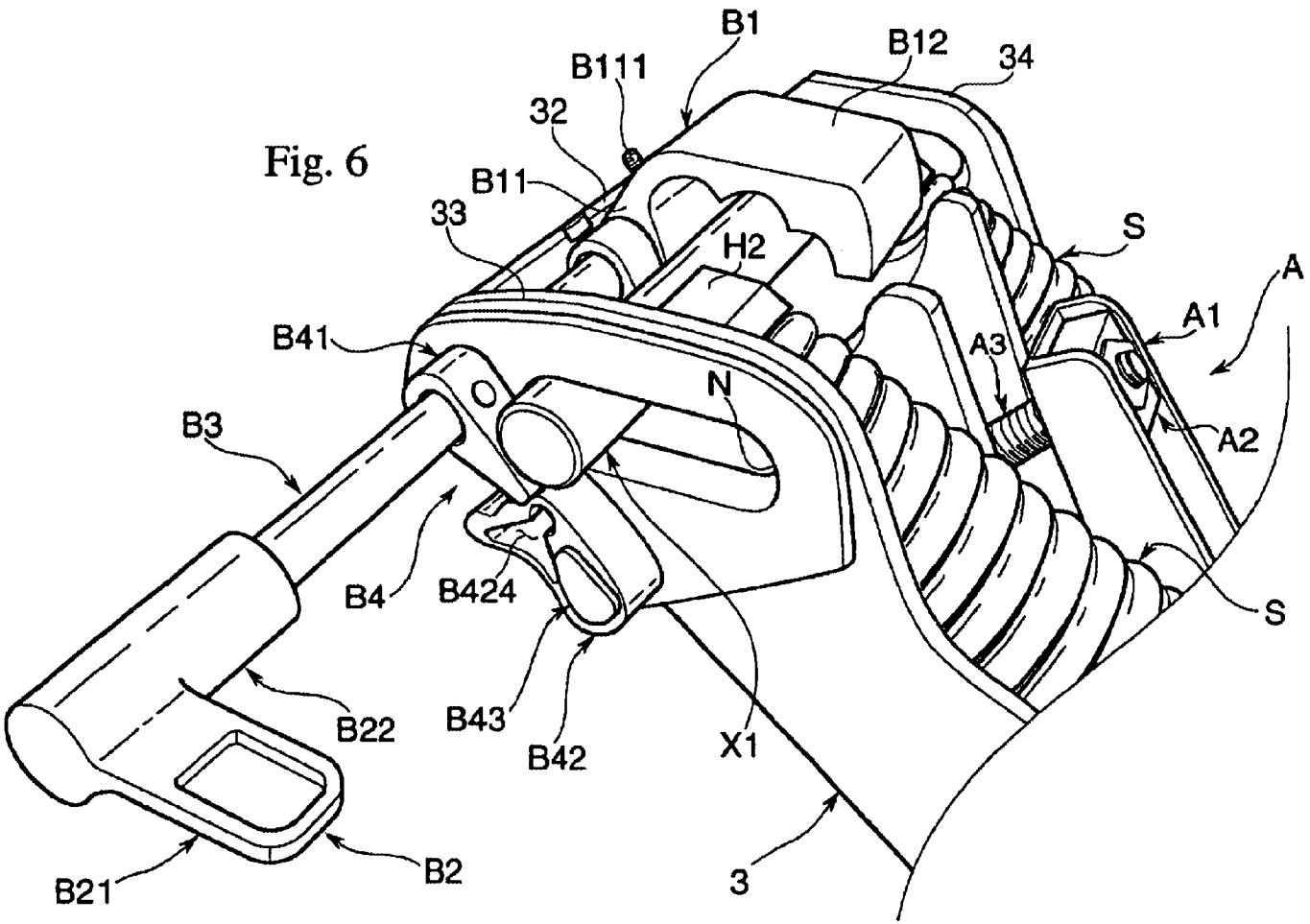
FIG. 6 is a perspective view showing a front portion of the supporting body in accordance with the embodiment.

The back frame 5 comprises, as shown in FIG. 2, a pair of back frame elements 51 each of which is in a shape of a character general "L" in a side view and a connecting member, not shown in drawings, that connects near upper end portions of a pair of the back frame elements 51 at a certain interval and is so arranged that an axis X2 shown in FIG. 3 and FIG. 5 can bridge between a pair of the back frame elements 51 at a portion between a proximal end 51*a* and a bent portion 51*b* of the back frame element 51. The proximal end 51*a* of each back frame elements 51 is mounted on the axis X3 of the supporting body 3 in a rotatable manner and a rear portion of the longitudinal frame 41 of the seat frame 4 is mounted on the axis X2 bridging between the back frame elements 51. The axis X2 connects the backrest 7 that is arranged rearward to the axis X1 and that includes the back frame 5 and the seat 6 in a rotatable manner and corresponds to the second axis described in claim 2 of the present claimed invention.

Figure 4:
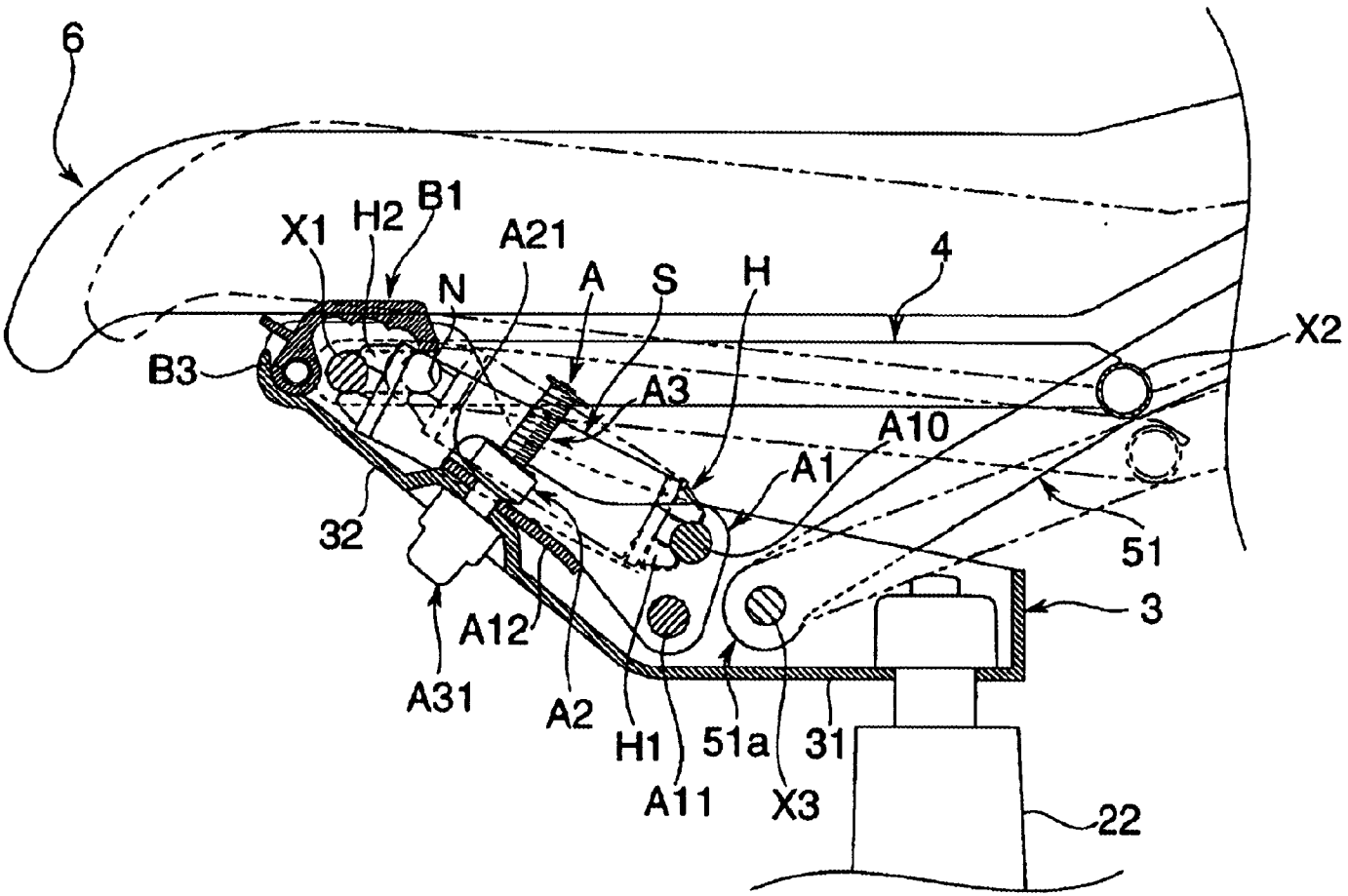
FIG. 4 is a longitudinal cross-sectional view showing around the supporting body in accordance with the embodiment.

With the above arrangement, as shown in FIG. 4 and FIG. 5, the chair body 1 achieves so-called a synchronized tilt mechanism as a whole by adopting a sliding engagement structure in which the axis X1 mounted on the seat frame 4 makes an engagement with the long hole N formed on the supporting body 3 in a slidable manner, wherein the chair C takes a upright posture with the back frame 5 stood uprightly, when the axis X1 locates at a rear side of the long hole N, while the chair C takes a rearward tilted posture with the back frame 5 tilted rearward and a rear end of the seat frame 4 sunk, when the axis X1 locates at a front side of the long hole N.

In the chair body 1 a reactive force mechanism H is incorporated into a part of the above-mentioned synchronized tilt mechanism and a reactive force adjusting mechanism A to adjust a hardness of rocking is also arranged.

The reactive force mechanism H comprises, as shown in FIG. 3, FIG. 4 and FIG. 5, a pair of coil springs S that is arranged in a space for storing mechanisms of the above-mentioned supporting body 3 in a rearward tilted posture and whose rear bottom end is supported by a fixed retainer H1 and a movable retainer H2 that is mounted around the axis X1 and is so arranged that a front upper end of the coil spring S is supported by the movable retainer H2 and the movable retainer H2 compresses the coil spring S when the axis X1 mounted on the seat frame 4 makes a sliding movement rearward in the long hole N in accordance with a rearward tilting movement of the back frame 5.

The reactive force adjusting mechanism A is so arranged, as shown in FIG. 3, FIG. 4 and FIG. 5, that the fixed retainer H1 of the coil spring S is held to fix at a position by an axial back up member A10 and comprises a rotational arm A1 that is rotatable around a horizontal axis A11 and that has the back up member A10 as a part thereof, a nut element arranged on a press plate A12 of the rotational arm A1 and a screw element A3 having a grip A31 that is screwed into at a position displaced from the horizontal axis A11 of the rotational arm A1 from a direction generally making a right angle with the displaced direction. The screw element A3 projects out of the front wall 32 of the supporting body 3 in a condition of penetrating the front wall 32 and the grip A31 is arranged at a position where the screw element A3 projects. When the screw element A3 is turned clockwise or counterclockwise with the grip A31, the rotational arm A1 rotates around the horizontal axis A11 so as to move a backup position of the fixed retainer H1 through the backup member A10 toward a direction to increase or decrease a compressive force of the coil spring S. As shown in FIG. 4 and FIG. 5, since a crossed axis angle between the rotational arm A1 and the nut element A3 varies in accordance with an operated position, a partial arc-shaped projection A21 is formed at a lower end side of the nut element A2 and the projection A21 is pushed against the press plate A12 of the rotational arm A1 so as to deal with a variation of the crossed axis angle.

As merits of the reactive force adjusting mechanism A, represented are a point that a length of an axial direction including the reactive force mechanism H can be downsized in an axial direction including the reactive force mechanism H in comparison with a case in which a reactive force adjusting mechanism is arranged in one side of the coil spring S because the reactive force adjusting mechanism A can be incorporated into the coil spring S in a longitudinal length, a point that a length of the supporting body 3 accommodating the coil spring S in a back and forth direction can be reduced, which makes it possible to secure an enough margin for movement by effectively avoiding an interference between the seat 6 and the supporting body 3 when the seat 6 is slid back and forth because the coil spring S is arranged in a rearward tilted posture (inclined generally 40 degrees in this embodiment), a point that the grip A31 for operation can be arranged on the accessible front wall 32 of the supporting body 3 and a point that the grip A31 can be operated with a small force due to the principle of "leverage" based on an arm length of the rotational arm A1.

In this embodiment, provided are a restraining member B1 that restrains a sliding range of the axis X1 changeably by directly acting on the axis X1, an operating member B2 that operates the restraining member B1, a transmitting axis B3 as a transmitting member that transmits an operating force of the operating member B2 to the restraining member B1 and a click stop mechanism B4 that fixes the restraining member B1 at a restraining position which will be described later, which makes it possible to change a range of rocking (inclined angle) and for the chair C to take a plurality of different tilted postures wherein the backrest can be tilted stepwisely.

Figure 7:
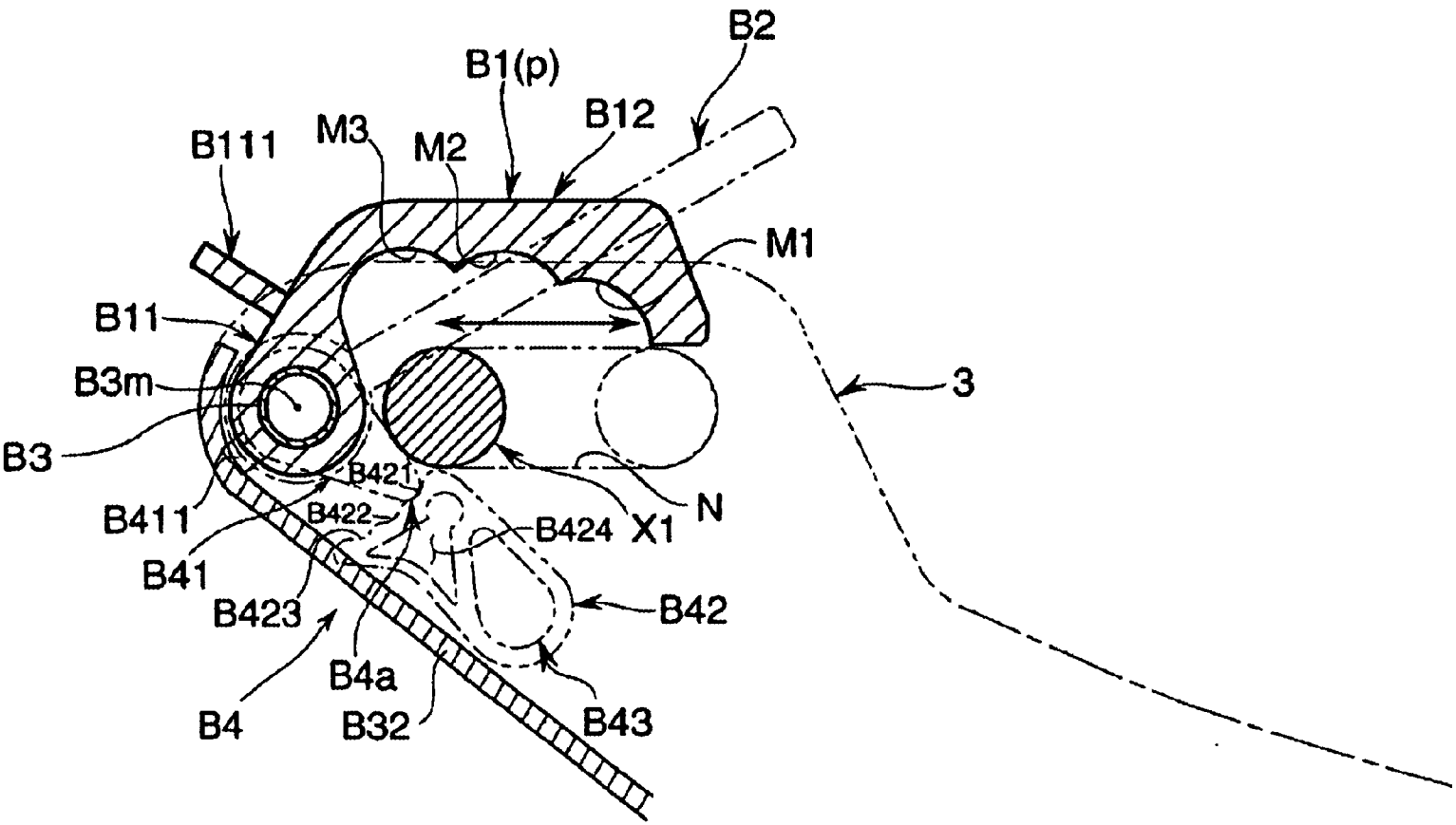
FIG. 7 is a cross-sectional view of a principal portion showing a movement of the restraining member in accordance with the embodiment.
Figure 8:
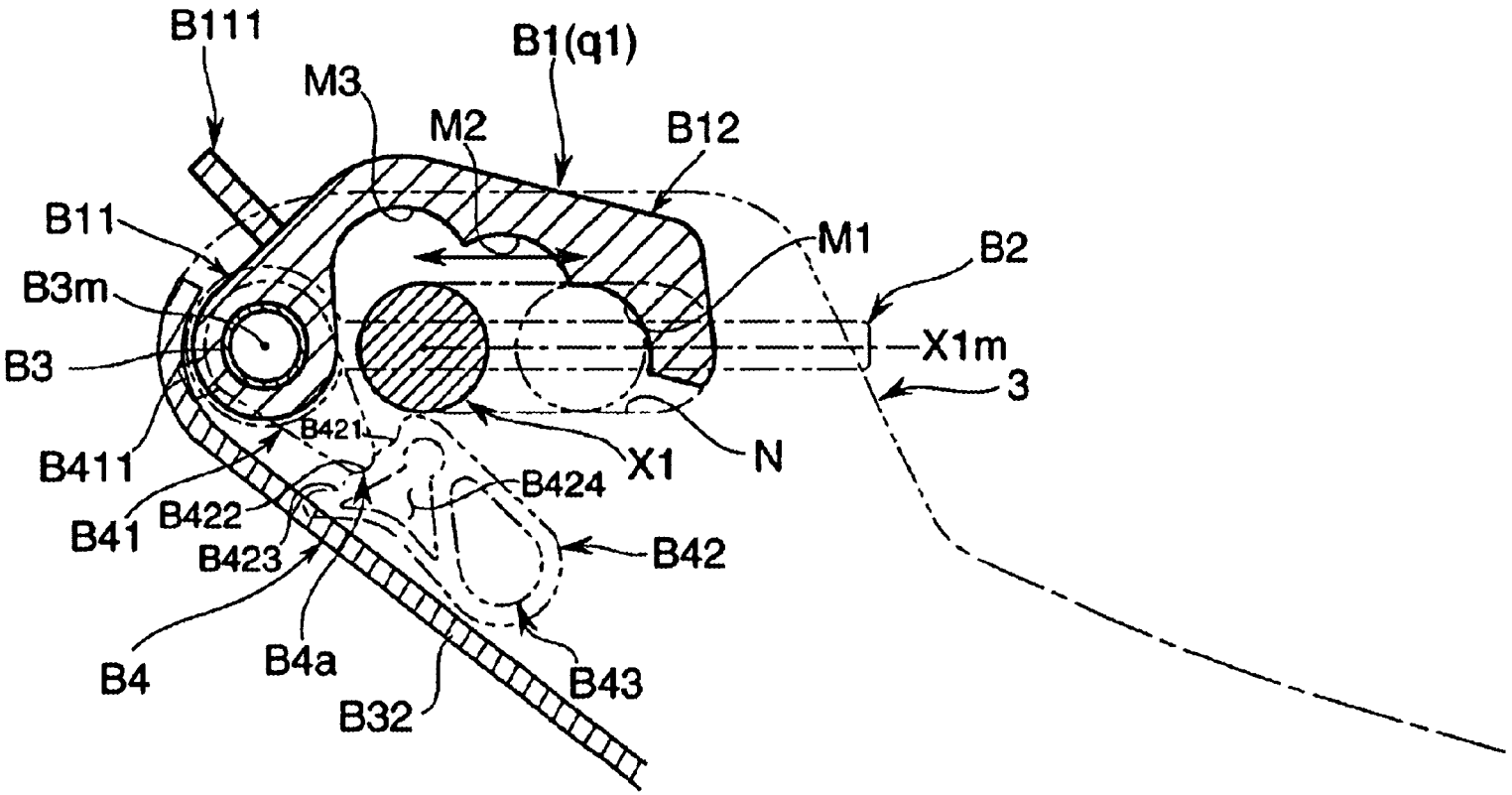
FIG. 8 is a cross-sectional view of a principal portion showing a movement of the restraining member in accordance with the embodiment.
Figure 9:
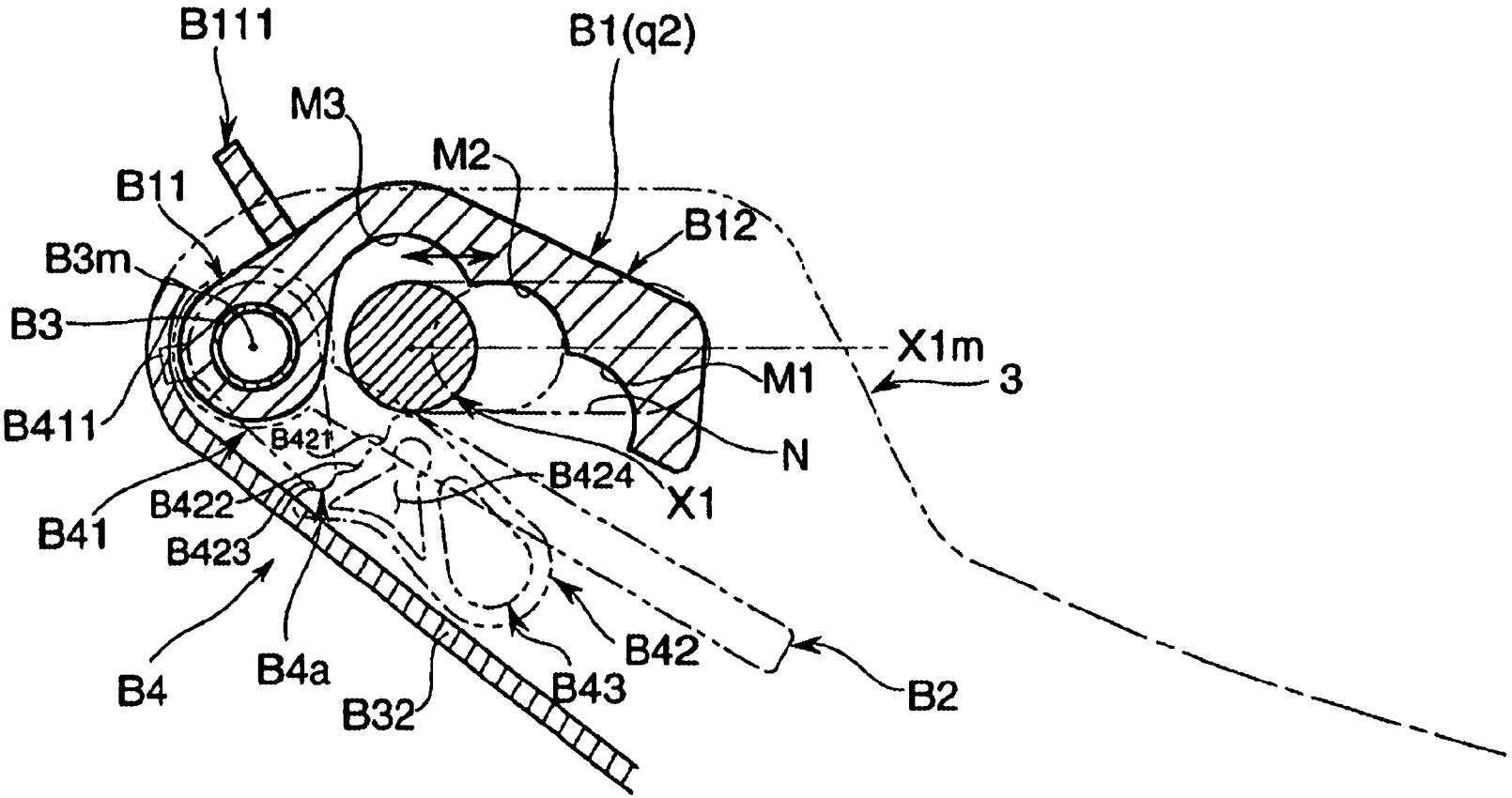
FIG. 9 is a cross-sectional view of a principal portion showing a movement of the restraining member in accordance with the embodiment.
Figure 10:
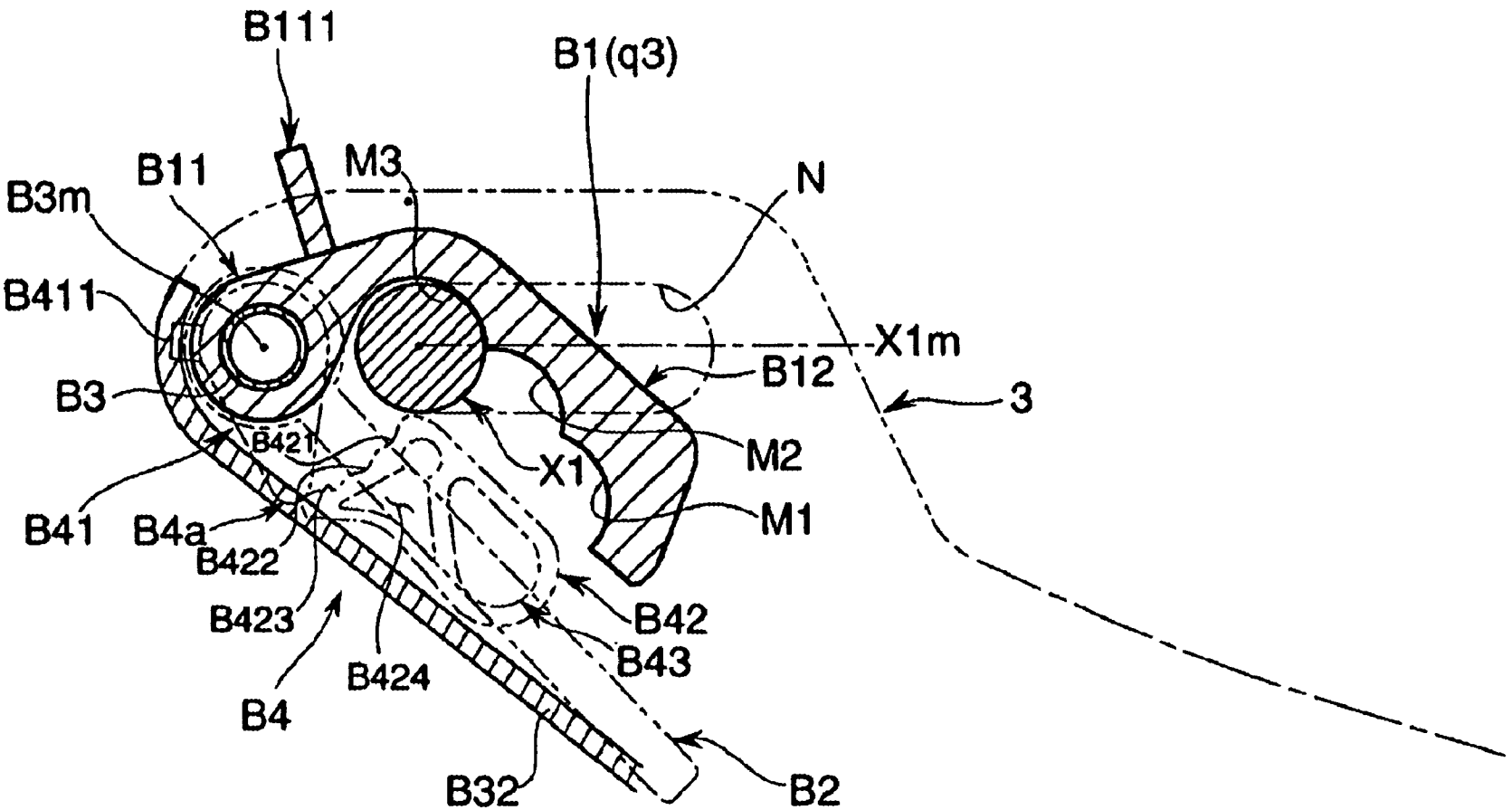
FIG. 10 is a cross-sectional view of a principal portion showing a movement of the restraining member in accordance with the embodiment.

The restraining member B1 is so arranged to move rotary among the recessed position shown in FIG. 7 (p), the restraining position (q1) shown in FIG. 8, the restraining position (q2) shown in FIG. 9 and the restraining position (q3) shown in FIG. 10 wherein a sliding range of the axis X1 is restrained in the long hole N by the operation of the operating member B2. More specifically, the restraining member B1 comprises a base portion B11 that is fixed to the transmitting axis B3 and a body portion B12 that extends from the base portion B11 toward a direction making a right angle with the transmitting axis B3 and is arranged at a general center along right and left of the front end portion of the supporting body 3. The base portion B11 is fixed to the transmitting axis B3 with the transmitting axis B3 penetrating and the restraining member B1 moves rotary around a shaft center B3*m* of the transmitting axis B3. The base portion B11 has an engaging portion B111, for example, a screw that projects and makes an abutting contact with the top end portion of the front wall 32 of the supporting body 3 to stop a rotary movement of the restraining member B1 toward a front direction reverse from a direction where the axis X1 locates. The body portion B12 extends rearward from the base portion B11 and is formed with restraining faces M1, M2 and M3 each of which makes an abutting contact with the axis X1 on a bottom face thereof at the restraining positions (q1), (q2) and (q3) so that either one of the restraining faces M1, M2 and M3 can selectively make an abutting contact with the axis X1. The three restraining faces M1, M2 and M3 are arranged at such a position corresponding to the above-mentioned restraining position (q1), (q2) or (q3) that a distance between each of the restraining faces M1, M2 and M3 and the shaft center B3*m* of the transmitting axis B3 differs each other and is so formed to have a partial arc shape in a side view corresponding to an outer face of the axis X1 so as to generally make an abutting contact with the axis X1 in a condition of tightly contact with the axis X1. The restraining faces M1, M2 and M3 restrain a sliding range of the axis X1 by making an abutting contact with a rear end side of the axis X1. In order to engage the axis X1 with the restraining face M1, M2, M3 more securely, it is preferable that the restraining face M1, M2, M3 reaches below a center line (shown by X1*m* in FIG. 8, FIG. 9 and FIG. 10) of the axis X1 at the restraining position (q1), (q2) or (q3).

The transmitting axis B3 is made of material such as metal having rigidity and is fixed to the restraining member B1 and arranged near the axis X1 to be parallel to the axis X1 extending right and left. More specifically, the transmitting axis B3 locates in front of the axis X1 and one end thereof is arranged inside of the base portion B11 while other end thereof projects out of a cover member K covering the left side wall 33 along the front wall 32 of the supporting body 3. The transmitting axis B3 is in a shape of a pipe as shown in FIG. 4 and FIG. 5, but it is not limited to this.

The operating member B2 is arranged at a distal end portion of the transmitting axis B3 and integrally formed with a lever portion B21 whose size and shape is easy to grip with a hand and a mounting portion B22 to mount the operating member B2 on the transmitting axis B3 so as to operate to rotate the lever portion B21 with a hand. The mounting portion B21 is formed in a shape of a cylinder and can be mounted on the transmitting axis B3 by fitting over the transmitting axis B3 projecting out of the cover member K.

The click stop mechanism B4 comprises a stopper B41 fixed to the transmitting axis B3 and an engaging member B42 that makes an engagement with the stopper B41 at a position corresponding to the recessed position (p), the restraining positions (q1), (q2), (q3). The stopper B41 is made of metal, formed to be generally in an ovoid shape projecting from the transmitting axis B3 toward one direction in side view through which the transmitting axis B3 penetrates and which is fixed to the transmitting axis B3 with a screw B411 and mounted at a position which makes an abutting contact with the outer face of the cover member K covering the left side wall 33 of the supporting body 3. (See FIG. 3) The engaging member B42 is made of elastic resin and formed with three concave engaging faces B421, B422 and B423 continuous along a back and forth direction so as to engage the distal end portion B41*a* of the stopper B41 and is so arranged that the stopper B41 can move to the adjacent engaging face B421, B422 or B423 by climbing over a convex boundary between the engaging faces B421 and B422, B422 and B423 or B421 and B423 with elastically transforming the convex boundary. A cavity B424 is arranged near the engaging faces B421, B422 and B423 for the sake of elastic transformation of the stopper B41. The engaging member B42 is mounted to fit over an outer face of a metal mounting member B43 that is fixed to the left side wall 33 of the supporting body 3 with an appropriate measure and whose cross-sectional side view is generally ovoid and is prohibited from rotation to the supporting body 3. The mounting member B43 is not limited to be ovoid, but may be any shape as far as it is non-circular that prohibits the engaging member B42 from rotation. Then when the stopper B41 is engaged with the engaging face B421, B422, B423 of the engaging member B42, the restraining member B1 is sequentially fixed at the recessed position (p) shown in FIG. 7, the restraining position (q1) shown in FIG. 8 and the restraining position (q2) shown in FIG. 9 and then the restraining member B1 climbs over the engaging face B423 as shown in FIG. 10 to locate at the front distal end portion (left side in FIG. 10) of the engaging member B42 and finally fixed at a restraining position (q3).

In accordance with the above arrangement of the chair C, in order to adjust a rocking range, the restraining member B1 is operated to fix at any one of the recessed position (p) and the restraining positions (q1), (q2) and (q3) by rotating the operating member B3 arranged at a front side under the seat 6 (left front side in this embodiment) in a seated condition. In this case, when the restraining member B1 is fixed at the recessed position (p), the axis X1 can be slid from the front end portion of the long hole N to the rear end portion thereof as shown in FIG. 7, the chair C takes a rearward tilted posture with the seat 6 sunk the most and the backrest 7 tilted largely. Then in accordance with an operation of rotating the restraining faces M1, M2, M3 sequentially so that the restraining faces M1, M2, M3 locates at the restraining positions (q1), (q2) and (q3) arranged at positions corresponding to the long hole N, a range in which the seat 6 sinks and an inclined angle of the backrest 7 become small. In case of the restraining position (q3), the backrest 7 is fixed to take an upright posture wherein both of the seat 6 and the backrest 7 do not move to take a rearward tilted posture. It is a matter of course that the reactive force adjusting mechanism A operates in a case that the restraining member B1 is arranged at any position of the recessed position (p) and the restraining positions (q1), (q2) and (q3).

Since the chair C with the above arrangement of this embodiment is provided with the restraining member B1 that makes it possible to change the sliding range of the axis X1 in the long hole N by directly acting on the axis X1 arranged at the front end portion of the seat frame 4 constituting the seat 6, the operating member B2 to operate the restraining member B1 can be arranged at a front end side of the chair C without difficulty just by arranging the transmitting axis B3 to transmit the operating force to the restraining member B1, which makes it easy for the seated person to operate the operating member B2.

In addition, since almost no other mechanical component is arranged at the front side of the supporting body 3 corresponding to the front side of the seat 6, the restraining member B1 and the transmitting axis B3 can be arranged in the space of the front side of the supporting body 3 without difficulty by making use of the space effectively. Since there is no need of considering interference between components, degree of freedom in design can be increased.

In this embodiment the sliding engagement structure for making the seat 6 and the backrest 7 rock in a synchronized manner is so arranged that the axis X1 as the first axis is mounted on the seat frame 4 and the long hole N as the sliding guide portion is formed on the supporting body 3. If the sliding engagement structure is so arranged that the first axis is arranged on the supporting body 3 and the sliding guide portion is formed on the seat frame 4, the sliding guide portion moves, which requires the restraining member itself move together with the sliding guide portion in order to restrain a sliding range. In comparison with this arrangement, the arrangement of this embodiment makes it possible to easily arrange the restraining member B1 on the supporting body 3 that does not move. It is easy for the seated person to operate the operating member B2 and it is structurally preferable because the operating member B2 does not move. Further, since the sliding guide portion is made of the long hole N, the sliding guide portion can be formed easily and the arrangement is also simplified.

In addition, since the restraining positions (q1), (q2) and (q3) are set to be thee steps by forming three restraining faces M1, M2 and M3 on the restraining member B1, four different rearward tilted postures can be taken including the recessed position (p), which makes it possible for the chair C to deal with varieties of preferences of the seated person.

Since the restraining member B1 is arranged to move rotary together with the transmitting axis B3 among the recessed position (p) and the restraining positions (q1), (q2) and (q3), an occupied area of the restraining member B2 accompanied with its movement can be reduced and whole of the restraining mechanism can be downsized because a movement of the transmitting axis B3 is a rotation alone.

Since the transmitting axis B3 that extends right and left is fixed to the restraining member B1 and the operating member B2 having the lever portion B21 at a distal end thereof is arranged on the transmitting axis B3, the restraining member B1 can be operated without a loss of operating force with a very simple arrangement.

Further, since the transmitting axis B3 is arranged near the axis X1 in parallel with the axis X1 and the restraining member B1 is arranged to make a right angle with the transmitting axis B3, the sliding range of the axis X1 can be restrained by a short-sized restraining member B1. In addition, since the transmitting axis B3 is arranged in front of the axis X1 in this embodiment, the bottom portion of the seat 6 of the chair C wherein a rocking range is adjustable can be downsized in a cy-pres manner by effectively making use of a space of the boat-shaped supporting body 3. With this arrangement, since the restraining member B1 restrains a sliding range of the axis X1 with wrapping around the axis X1, the axis X1 can be engaged at each of the restraining points (q1), (q2) and (q3) precisely. Further, since each of the restraining faces M1, M2 and M3 has a shape that tightly attaches to the outer face of the axis X1, it is possible to engage the restraining member B1 with the axis X1 more securely.

In addition, since the restraining member B1 is arranged at a general center along right and left of the supporting body 3, more specifically, at a position corresponding to a general center along right and left of the seat 6, a sliding range of the axis X1 mounted on the seat 6 can be restrained effectively and in an well-balanced manner.

This invention is not limited to the arrangement of the above embodiment.

For example, the restraining member may have one restraining face or may have more than four restraining faces.

In addition, the restraining member may restrain a sliding range of the first axis by moving back and forth or transforming a part thereof.

Further, the transmitting axis that is fixed to the restraining member may be arranged under the first axis and the restraining member may extend upward from the transmitting axis. In addition, the transmitting axis may be arranged rear of the first axis and the restraining member may extend forward from the transmitting axis.

Figure 11:
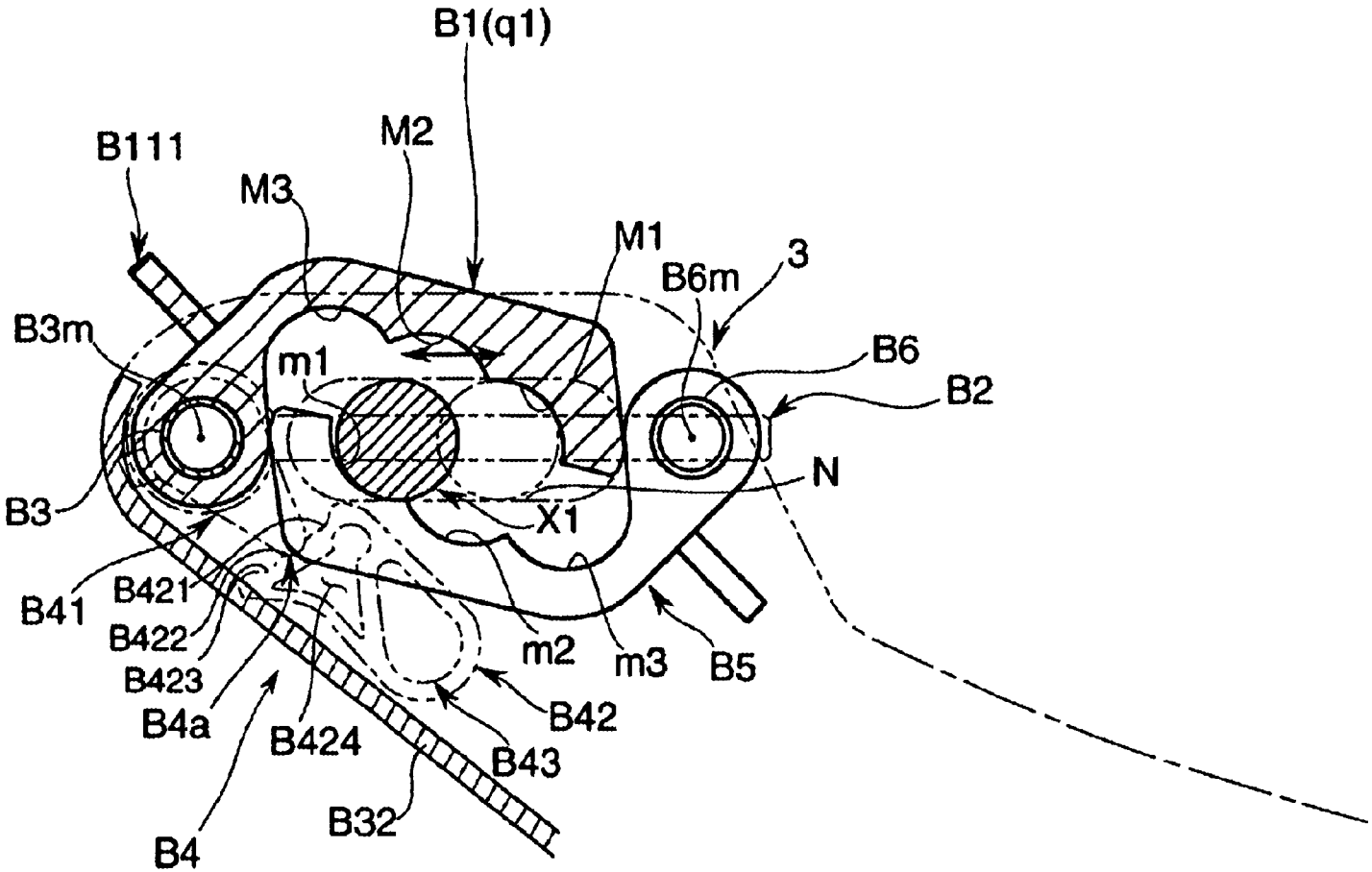
FIG. 11 is a cross-sectional view of a principal portion showing another embodiment of the present claimed invention.
Figure 12:
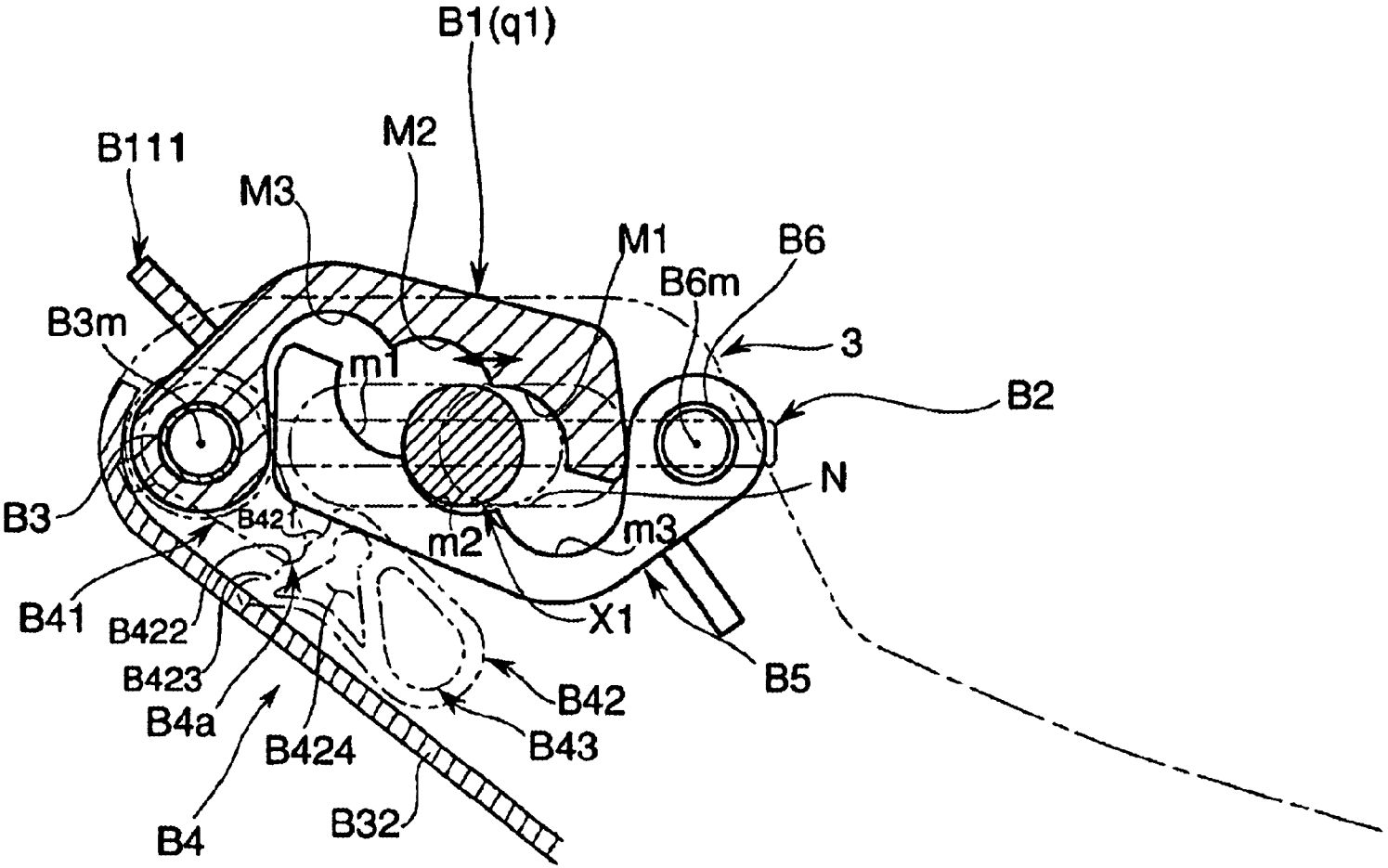
FIG. 12 is a cross-sectional view of a principal portion showing another embodiment of the present claimed invention.

As shown in FIG. 11 and FIG. 12, a second restraining member B5 that restrains a sliding range at a front side of the axis X1 may be further arranged in addition to the restraining member B1. In FIG. 11 and FIG. 12 a same code is given to the same component as that in the above embodiment. The second restraining member B5 in FIG. 11 and FIG. 12 has the same shape as that of the first restraining member B1 and is mounted in a vertically reversed manner, but it is a matter of course that the second restraining member B5 may have a different shape. The second restraining member B5 is shown by a solid line in FIG. 11 and FIG. 12. Restraining faces m1, m2 and m3 are formed on a body portion B52 of the second restraining member B5, a transmitting axis B6 is fixed to a base portion B51 of the second restraining member B5 and an operating member, not shown in drawings, is mounted on a distal end of the transmitting axis B6. The second restraining member B5 is so arranged to be operated independently from the restraining member B1 and rotates around the shaft center B6*m* of the transmitting axis B6. In accordance with the arrangement, for example, the sliding range of the axis X1 can be restrained by the restraining face M1 of the restraining member B2 and the restraining face m1 of the second restraining member B5 as shown in FIG. 11, or restrained by the restraining face M1 of the restraining member B2 and the restraining face m2 of the second restraining member B5 as shown in FIG. 12, which makes it possible for the chair to take a rearward tilted posture in a more fine manner.

Each concrete arrangement is not limited to the above-mentioned embodiment, and there may be various modifications without departing from a spirit of the present claimed invention.

The present claimed invention is embodied by the above-mentioned embodiment and produces the following effects.

In accordance with the chair of the present claimed invention, it is possible to change a rocking range of the seat and the backrest by the restraining member and also possible to arrange a member or a mechanism for operating to change the rocking range at a front side of the seat that is accessible for the seated person without difficulty. In addition, since there are a few members or mechanisms arranged at a front end side of the seat or the supporting body, it is possible to arrange the restraining member of the member or the mechanism to operate the restraining member without considering interference between the member or the mechanism, resulting in improvement of degree of freedom in design.

What is claimed is:

1. A chair comprising a first axis that extends right and left and that connects a seat and a supporting body arranged under the seat in a rotatable manner at a front end portion of the seat, a second axis that connects the seat and a backrest in a rotatable manner at a rear side to the first axis and a third axis that connects the backrest and the supporting body in a rotatable manner, wherein the seat and the backrest make a rocking movement between an upright posture and a rearward tilted posture with synchronizing of the seat and the backrest by adopting a sliding engagement structure to a supporting portion of the first axis, the chair further comprising a restraining member to restrain a sliding range of the first axis by directly acting on the first axis, wherein the restraining member is capable of moving or transforming between a restraining position where the sliding range of the first axis is restrained and a recessed position where the sliding range of the first axis is not restrained, and wherein the restraining position can be set at a plurality of different positions and the restraining member restrains the sliding range of the first axis at any one of the different positions.

2. The chair described in claim 1, wherein the first axis is set at a seat side, the sliding engagement structure comprises the first axis and a sliding guide portion that is formed on the supporting body and that guides the first axis in a slidable manner and the restraining member is arranged on the supporting body.

3. The chair described in claim 2, wherein the sliding guide is a long hole arranged on the supporting body.

4. The chair described in claim 2, wherein the chair further comprises an operating member to operate the restraining member in a movable or transformable manner and a transmitting member that transmits an operating force of the operating member to the restraining member.

5. The chair described in claim 2, wherein the restraining member restrains the sliding range of the first axis at a rear side of the first axis.

6. The chair described in claim 1, wherein the chair further comprises an operating member to operate the restraining member in a movable or transformable manner and a transmitting member that transmits an operating force of the operating member to the restraining member.

7. The chair described in claim 6, wherein the restraining member moves rotary between the restraining position and the recessed position with the operation of the operating member.

8. The chair described in claim 7, wherein the plurality of different restraining positions are set in a stepwise manner.

9. The chair described in claim 6, wherein the transmitting member is a transmitting axis that extends right and left and that is fixed to the restraining member and the operating member is arranged at a distal end of the transmitting axis.

10. The chair described in claim 9, wherein the restraining member extends toward a direction making a right angle with the transmitting member and is so arranged to rotate together with the transmitting axis with the operation of the operating member.

11. The chair described in claim 10, wherein the transmitting axis is arranged near the first axis in parallel with the first axis.

12. The chair described in claim 10, wherein the restraining member is arranged at a general center along right and left of the supporting body.

13. The chair described in claim 1, wherein the plurality of different restraining positions are set in a stepwise manner.

14. The chair described in claim 13, wherein the restraining member is provided with a plurality of restraining faces that restrain a sliding movement by making an abutting contact with the first axis at the plurality of different restraining positions and the plurality of the restraining faces are so arranged that one of a plurality of the restraining faces selectively makes an abutting contact with the first axis with the operation of the operating member.

15. The chair described in claim 14, wherein a click stop mechanism is arranged to fix the restraining member at a position corresponding to one of the plurality of different restraining positions.

16. The chair described in claim 13, wherein a click stop mechanism is arranged to fix the restraining member at a position corresponding to one of the plurality of different restraining positions.

17. The chair described in claim 1, wherein the restraining member is arranged at a general center along right and left of the supporting body.

18. The chair described in claim 17, wherein the restraining member restrains the sliding range of the first axis at a rear side of the first axis.

19. The chair described in claim 1, wherein the restraining member restrains the sliding range of the first axis at a rear side of the first axis.

20. The chair described in claim 19, wherein the chair further comprises a second restraining member that restrains the sliding range of the first axis at a front side of the first axis.

* * * * *